United States Patent [19]

Gannon et al.

[11] Patent Number: 4,661,790

[45] Date of Patent: Apr. 28, 1987

[54] RADIO FREQUENCY FILTER HAVING A TEMPERATURE COMPENSATED CERAMIC RESONATOR

[75] Inventors: Mark A. Gannon; Richard S. Kommrusch, both of Schaumburg; Francis R. Yester, Jr., Arlington Heights, all of Ill.

[73] Assignee: Motorola, Inc., Schaumburg, Ill.

[21] Appl. No.: 816,672

[22] Filed: Jan. 2, 1986

Related U.S. Application Data

[63] Continuation of Ser. No. 562,901, Dec. 19, 1983, abandoned.

[51] Int. Cl.[4] ..... H01P 7/10; H01P 1/20

[52] U.S. Cl. ..... 333/234; 333/235; 333/202

[58] Field of Search ..... 333/234, 235, 231, 229, 333/227, 219, 202

[56] References Cited

U.S. PATENT DOCUMENTS

| | | | |
|---|---|---|---|
| 3,621,476 | 11/1971 | Kambayashi | 333/1.1 |
| 3,633,104 | 1/1972 | Gray et al. | 333/229 X |
| 3,681,713 | 8/1972 | Degenkolb et al. | 333/204 X |
| 3,713,051 | 1/1973 | Kell | 333/202 |
| 3,798,578 | 3/1974 | Konishi et al. | 333/234 |
| 3,919,672 | 11/1975 | Plourde | 333/234 |
| 3,924,208 | 12/1975 | Plourde | 333/234 |
| 3,938,064 | 2/1976 | O'Bryan, Jr. et al. | 333/204 X |
| 3,973,226 | 8/1976 | Affolter et al. | 333/202 |
| 4,019,161 | 4/1977 | Kimura et al. | 333/234 |
| 4,024,481 | 5/1977 | Kivi | 333/229 |
| 4,028,652 | 6/1977 | Wakim et al. | 323/235 X |
| 4,122,418 | 10/1978 | Nagao | 333/219 |
| 4,124,830 | 11/1978 | Ren | 333/208 |
| 4,136,320 | 1/1979 | Nishikawa et al. | 333/234 |
| 4,156,860 | 5/1979 | Atia et al. | 333/229 |
| 4,172,240 | 10/1979 | Jerinic | 331/56 |
| 4,189,684 | 2/1980 | Hieber et al. | 331/56 |
| 4,241,322 | 12/1980 | Johnson et al. | 333/202 |
| 4,271,399 | 6/1981 | Morita | 333/219 |
| 4,375,622 | 3/1983 | Hollingsworth et al. | 333/126 |

FOREIGN PATENT DOCUMENTS

| | | | |
|---|---|---|---|
| 1225254 | 9/1966 | Fed. Rep. of Germany | 333/235 |
| 0141803 | 11/1980 | Japan | 333/219 |

OTHER PUBLICATIONS

Jonker and Kestroce, "The Terneary Systems BaO–Ti-$O_2$–$SnO_2$, and BaO–$TiO_2$.$ZrO_2$", *Journal American Ceramic Society,* vol. 41, #10, 10/1978, pp. 390–394.

M. R. Stiglitz and J. C. Sethares, "Frequency Stability in Dielectric Resonators", Proceedings of the IEEE, 1965, pp. 311 & 312.

*Primary Examiner*—Eugene R. LaRoche
*Assistant Examiner*—Benny T. Lee
*Attorney, Agent, or Firm*—Rolland R. Hackbart

[57] ABSTRACT

An RF filter (100) includes a ceramic resonator (116) sandwiched between first and second compensating discs (114 and 120) for temperature compensation, low loss mounting and heat sinking of the ceramic resonator (116). Good thermal contact between the ceramic resonator (116) and discs (114 and 120) is produced by a compressive force applied by copper plates (112 and 128) and copper can (124). The resonant frequency of the RF filter is tuned by means of a copper-plated tuning shaft (104) and ceramic tuning slug (118) which are positioned by brass bushing (134) in copper pipe (130 and 132). Input and output signals are coupled to the RF filter via respective probes (122).

13 Claims, 3 Drawing Figures

RADIO FREQUENCY FILTER HAVING A TEMPERATURE COMPENSATED CERAMIC RESONATOR

This is a continuation, of application Ser. No. 562,901, filed Dec. 19, 1983, now abandoned.

BACKGROUND OF THE INVENTION

The present invention relates generally to radio frequency (RF) filters and more particularly to an RF filter having a temperature compensated ceramic resonator adaptable for use in antenna combiners coupling a plurality of RF transmitters to a single antenna.

In order to combine a number of RF transmitters, the RF signals from each transmitter must be isolated from one another to prevent intermodulation and possible damage to the transmitters. RF filters of the air-filled cavity type may be utilized to provide isolation between the RF transmitters. Each such cavity filter is tuned to pass only the RF signal from the transmitter to which it is connected, each RF transmitter producing a different frequency RF signal. A conventional mechanism utilized to temperature compensate such cavity filters is described in U.S. Pat. No. 4,024,481. However, such air-filled cavity filters are both expensive and relatively large in size such that these cavity filters consume an inordinate amount of precious space at remote antenna sites located on top of buildings and mountains.

The size of such RF filters can be reduced by utilizing a ceramic resonator. One such filter utilizing a ceramic resonator is described in U.S. Pat. No. 4,241,322. Although providing a more compact filter, the ceramic resonator in such a filter is not temperature compensated for temperature changes in the ceramic due to RF power dissipation in the ceramic and therefore can experience large shifts in resonant frequency due to RF power dissipation and the fact that the ceramic cannot be made with exactly zero temperature coefficient. Another filter described in U.S. Pat. No. 4,019,161 utilizes conventional mechanisms to temperature compensate a ceramic resonator mounted on a micro-integrated circuit substrate, but does not provide for dissipation of heat in the ceramic resonator.

OBJECTS AND SUMMARY OF THE INVENTION

Accordingly, it is an object of the present invention to provide a compact and inexpensive RF filter having a uniquely temperature compensated ceramic resonator.

It is another object of the present invention to provide an improved RF filter having a temperature compensated ceramic resonator and a ceramic tuning slug for linearly changing the resonant frequency of the ceramic resonator.

It is yet a further object of the present invention to provide an improved RF filter having a temperature compensated ceramic resonator that is thermally coupled to the filter housing for minimizing temperature rise due to power dissipation in the ceramic resonator.

Briefly described, the present invention encompasses an RF filter comprising a dielectric resonator sandwiched between first and second dielectric compensating discs. The resonator and first compensating disc may have concentrically aligned holes therein into which a ceramic tuning slug is inserted for adjusting the resonant frequency of the ceramic resonator. The resonator, first and second compensating discs, and tuning slug are enclosed and maintained in spatial relationship with one another by a metal housing. Input and output signals may be coupled to and from the RF filter by means of respective input and output probes which may be located at any suitable location on the copper housing.

DETAILED DESCRIPTION OF THE PREFERRED EMBODIMENT

Figure 1:
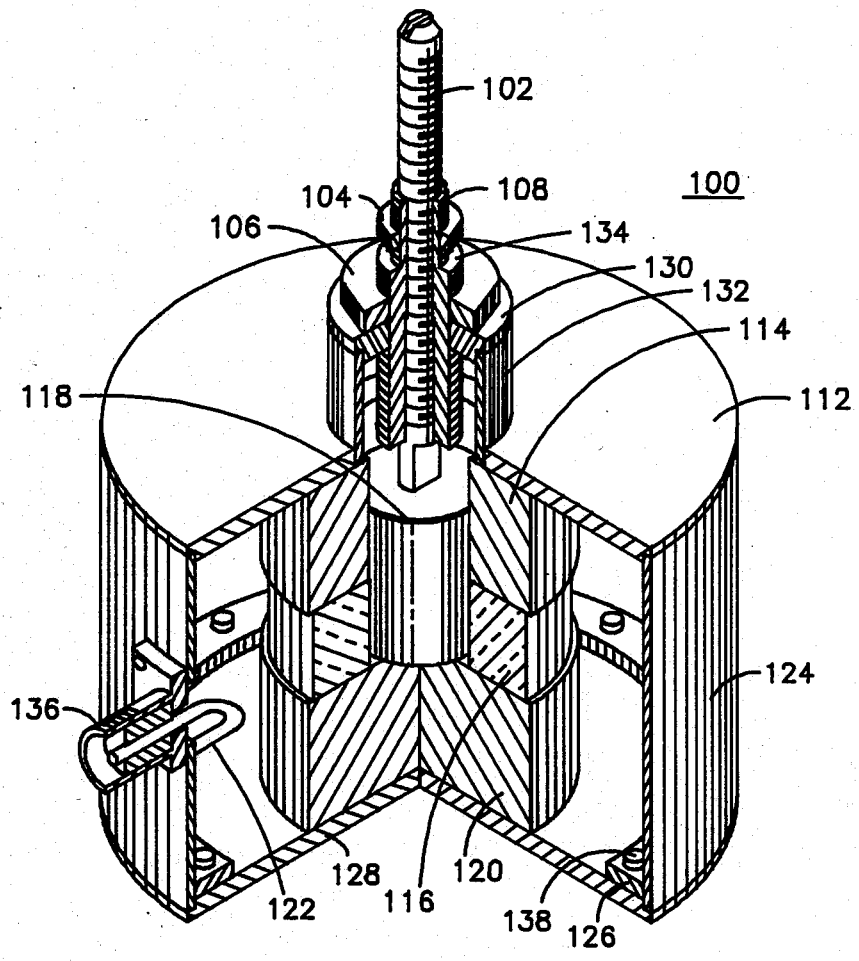
FIG. 1 is a perspective cutaway view of the preferred embodiment of the RF filter of the present invention.

In FIG. 1, there is illustrated a perspective view of an RF filter 100 embodying the present invention. A portion of filter 100 has been cut away to more clearly illustrate the internal structure thereof.

Figure 2:
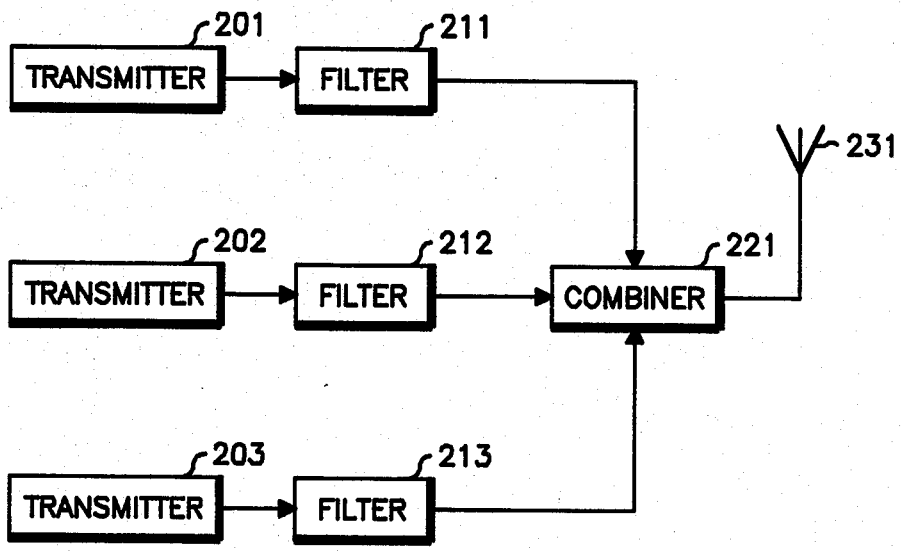
FIG. 2 is a block diagram of combining apparatus advantageously utilizing RF filters embodying the present invention for coupling RF signals from respective RF transmitters to a combiner for application to a common antenna.

Filter 100 in FIG. 1 is particularly well adapted for use in the antenna combiner in FIG. 2 which combines two or more RF transmitters operating in the frequency range from 870–890 mHz. The nominal unloaded Q of filter 100 is approximately 14,000. The frequency shift of filter 100 over the ambient temperature range of −30° C. to +60° C. is a maximum of 55 kHz with respect to the nominal frequency at room temperature. The nominal dimensions of filter 100 are 5.5" in diameter and 3" in length, as compared to 6" in diameter and 13" in length for a conventional air-filled cavity filter. In addition, filter 100 results in a materials cost saving of 60% over an equivalent air-filled cavity filter.

Referring to FIG. 1, filter 100 includes a ceramic resonator 116 which is sandwiched between a first compensating disc 114 and second compensating disc 120. Resonator 116 is preferably comprised of a ceramic compound including barium oxide, titanium oxide and zirconium oxide and having a dielectric constant of at least twenty (20). One such ceramic compound suitable for use is that described in an article by G. H. Jonker and W. Kwestroo, entitled "The Ternary Systems $B_aO$-$T_iO_2$-$S_nO_2$ and $B_aO$-$T_iO_2$-$Z_rO_2$", published in the Journal of American Ceramic Society, Volume 41, Number 10, October 1958, at pages 390–394 (incorporated herein by reference thereto). Of the ceramic compounds described in this article, the compound $Ba_2Ti_9O_{20}$ in Table VI having the composition 18.5 mole percent BaO, 77.0 mole percent $TiO_2$ and 4.5 mole percent $ZrO_2$ and having a dielectric constant of 40 is suitable for use in resonator 116. Many of the other compositions of the type described in this article may likewise be utilized. Compensating discs 114 and 120 are preferably comprised of alumina ($Al_2O_3$) since alumina exhibits low dielectric loss, high thermal conductivity relative to ceramic resonator 116 and a positive dielectric temperature coefficient with respect to that of ceramic resonator 116.

According to an important feature of the present invention, the negative dielectric temperature coefficient of ceramic resonator 116 can be substantially compensated by the positive dielectric temperature coefficient of alumina compensating discs 114 and 120. That is, the −36 ppm/°C. dielectric temperature coefficient of the ceramic resonator 116 can be substantially offset by the +113 ppm/°C. dielectric temperature coefficient of the alumina compensating discs 114 and 120, or the +7 ppm/°C. frequency temperature coefficient of the ceramic resonator 116 can be substantially offset by the −63 ppm/°C. frequency temperature coefficient of the alumina compensating discs 114 and 120. As is known in the art, the frequency temperature coefficient of a dielectric material is opposite in polarity to the dielectric temperature coefficient and is proportional to both the physical size and the dielectric temperature coefficient of that dielectric material. Therefore, the desired compensation is achieved by selecting the proper thickness of alumina compensating discs 114 and 120.

Moreover, the alumina compensating discs 114 and 120 provide for ambient temperature compensation, minimize temperature rise due to RF power dissipation of ceramic resonator 116 by providing a low thermal resistance between ceramic resonator 116 and the top and bottom plates 112 and 128 of the filter housing, and minimize the overall RF loss of the filter by supporting the resonator 116 away from the loss-inducing plates 112 and 128 with low-loss alumina. A compressive force exerted by plates 112 and 128 maintains good thermal contact between resonator 116 and discs 114 and 120 such that the thermal resistance between the resonator 116 and the filter housing is less than 1° C./W (i.e. 0.68° C./W predicted by design analysis). Therefore, according to another feature of the present invention, filter 100 can accomodate high power transmitters since the temperature rise due to power dissipation in the ceramic resonator 116 is minimized by the relatively low thermal resistance between the ceramic resonator and the filter housing. That is, with twelve watts of RF energy dissipated in the filter 100, the temperature of ceramic resonator 116 will rise only 8° C. above ambient temperature and the frequency of filter 100 will drift only 42 kHz.

Referring back to FIG. 1, the copper housing for filter 100 both totally encloses the sandwiched ceramic resonator 116 and provides a compressive force for maintaining the spatial relationship between ceramic resonator 116 and alumina compensating discs 114 and 120. The housing includes a copper top plate 112 which mates with copper can 124. Top plate 112 is soldered to can 124. Can 124 also includes an inside ring 126 which has threaded holes for accepting screws 138. Copper bottom plate 128 is attached to can 124 by means of screws 138. Ceramic resonator 116 and alumina compensating discs 114 and 120 are held together by means of a compressive force that is exerted by bottom plate 128. Ceramic resonator 116 and alumina compensating discs 114 and 120 may also be bonded with a suitable adhesive such as glass frit or bonding film.

According to another feature of the present invention, resonator 116 together with discs 114 and 120 may be individually or collectively sealed to prevent degradation of filter electrical characteristics due to humidity. The resonator 116 and discs 114 and 120 may be hermetically sealed with a low-loss glass such as Engelhard A-3702 dielectric ink which is fired at high temperature.

The resonant frequency of ceramic resonator 116 may be linearly adjusted by means of tuning shaft 102 and dielectric tuning slug 118 attached thereto. The resonant frequency of resonator 116 linearly decreases as tuning slug 118 is inserted into substantially concentric holes in disc 114 and resonator 116. Tuning slug 118 is preferably comprised of the same ceramic used for ceramic resonator 116. However, in other applications, tuning slug 118 may be any suitable dielectric material. The tuning slug 118 not only produces linear changes in resonant frequency, but also eliminates some spurious resonant modes (by keeping the overall copper housing dimensions constant as the frequency of resonator 116 is tuned), minimizes resonator de-Q-ing (because it employs a low-loss dielectric), and allows discs 114 and 120 to be in good thermal contact with resonator 118 over its entire top and bottom surfaces. Although resonator 116 is preferably tuned by means of tuning slug 118, other suitable conventional tuning apparatus may also be utilized.

Tuning shaft 102 is preferably comprised of copper-plated nickel steel (such as "Invar"). Tuning shaft 102 is threaded and mates with a corresponding threaded inside top portion 108 of bushing 134. Bushing 134 has a larger threaded outside bottom portion which inserts into a corresponding threaded portion of copper pipe cover 130. Pipe cover 130 is soldered to copper pipe 132 which is in turn soldered to top plate 112. The inside bottom portion of bushing 134 is not threaded so that tuning shaft 102 is fixedly held only at the inside top portion 108 of bushing 134. The top portion 108 of bushing 134 is also slotted and threaded on the outside so that locknut 104 may be utilized to fix the position of tuning shaft 102 and ceramic tuning slug 118. Also, a bushing locknut 106 is utilized to fix the position of the bottom portion of bushing 134 with respect to pipe cover 130.

According to another feature of the present invention, bushing 134, tuning shaft 102, pipe cover 130 and pipe 132 may be comprised of different materials each having different coefficients of expansion for compensating for changes in the resonant frequency of resonator 116 with ambient temperature. For example, tuning shaft 102 is preferably comprised of copper-plated nickel steel, bushing 134 is preferably comprised of brass, pipe cover 130 and pipe 132 are preferably comprised of copper. The movement of ceramic tuning slug 118 over ambient temperatures may be varied by varying the effective length of the brass bushing 134. The effective length of brass bushing 134 is adjusted by turning bushing 134 in or out of pipe 132. The temperature compensation is then achieved by the difference in the coefficient of expansion between, and respective sizes of, tuning shaft 102, brass bushing 134, and copper pipe 132. This arrangement can compensate for a worst case change of 0.8 ppm/°C. of the frequency temperature coefficient of the entire filter.

Figure 3:
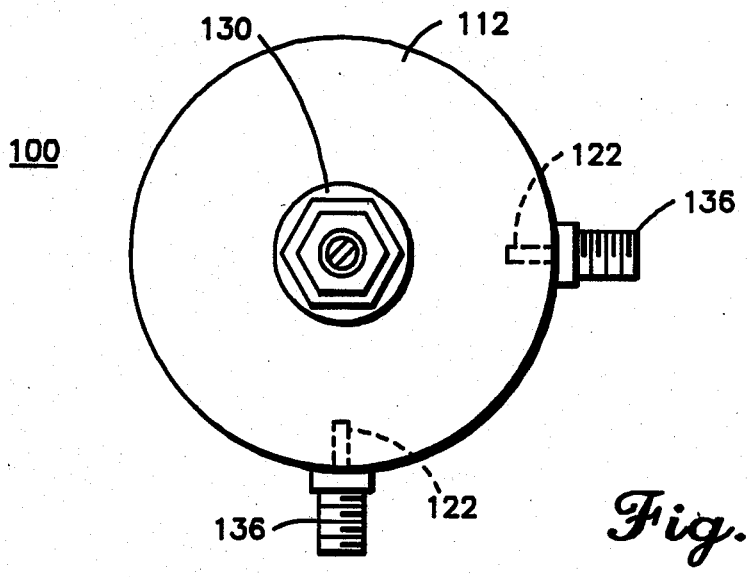
FIG. 3 is a top view of the RF filter illustrated in FIG. 1.

RF signals are coupled to and from filter 100 by means of two probes 122 accessed by respective connectors 136. In the preferred embodiment of filter 100, two probes 122 are located substantially opposite resonator 116 on can 124 at 90° with respect to one another, as shown in FIG. 3. For space economy, probes 122 may be located at any suitable location on the filter housing, such as, for example, on top plate 112.

The dimensions of the various elements of an embodiment of filter 100 for operation at frequencies between 865–902 MHz are listed below in Table I. In this embodiment, the resonator 116 and tuning slug 118 are comprised of the ceramic compound $Ba_2Ti_9O_{20}$, discs 114 and 120 of alumina, tuning shaft 102 of copper-plated nickel steel, bushing 134 of brass and the filter housing of copper. The exact dimensions of the elements of the filter embodiment will vary depending on the desired frequency of operation and the materials chosen for each of the elements.

TABLE I

| Element | | Filter Dimensions In Inches Outer Diameter | Inner Diameter | Length |
|---|---|---|---|---|
| Resonator | 116 | 2.680 | 1.260 | 0.772 |
| Disk | 114 | 2.800 | 1.260 | 1.139 |
| Disk | 120 | 2.800 | — | 1.127 |
| Slug | 118 | 1.225 | — | 1.355 |
| Shaft | 102 | 0.375 | — | 3.500 |
| Can | 124 | 5.625 | 5.500 | 3.145 |
| Pipe | 132 | 1.625 | 1.500 | 1.000 |
| Bushing | 134 | 0.750 | 0.375 | 1.250 |

Referring next to FIG. 2, there is illustrated antenna combining apparatus for coupling RF transmitters 201, 202 and 203 having different signal frequencies to a common antenna 231. Filters 211, 212, and 213 are preferably filters 100 embodying the present invention. Combiner 221 may be any suitable conventional antenna combiner such as that shown and described in the U.S. Pat. No. 4,375,622, which is incorporated herein by reference thereto. By utilizing the RF filter 100 of the present invention for filters 211, 212 and 213, the overall size and space requirements of the combining apparatus in FIG. 2 can be significantly reduced. Since space is at a premium in remotely located antenna sites, a substantial cost savings can be realized by utilizing the filter 100 of the present invention.

In summary, a unique high Q RF filter has been described that includes a temperature compensated ceramic resonator. The unique filter is temperature compensated, is thermally optimized so that temperature rise due to power dissipation in the ceramic resonator is minimized and has low overall RF loss. Moreover, the unique filter is substantially smaller than conventional air-filled cavity filters. The RF filter of the present invention may be advantageously utilized in any suitable application, such as, for example, combining apparatus for coupling multiple RF transmitters having different signal frequencies to a common antenna.

We claim:

1. A radio frequency (RF) filter coupled to an input signal from a signal source and producing an output signal, said RF filter comprising:

resonating means, having top and bottom surfaces with, a hole disposed therebetween, being comprised of a ceramic material having a predetermined thermal conductivity and a predetermined rate of change of resonant frequency with temperature;

first and second compensating means each having top and bottom surfaces and being disposed above and below the resonating means, respectively, the bottom surface of the first compensating means and the top surface of the second compensating means being thermally coupled to the top and bottom surfaces of the resonating means, respectively, the first compensating means including a hole substantially concentrically aligned with the hole of the resonating means, and the first and second compensating means being comprised of a dielectric material having a rate of change of resonant frequency with temperature opposite in polarity to the predetermined rate of change, and the dielectric material of the first and second compensating means further having a thermal conductivity grater than the predetermined thermal conductivity of the resonating means ceramic material;

tuning means comprised of a dielectric material and being insertable into the holes of the first compensating means and resonating means for changing the resonant frequency of the resonating means; and housing means including an input probe for coupling the input signal to said RF filter, an output prove disposed at a predetermined distance from the input probe for coupling the output signal from said RF filter, and top and bottom surfaces, and side surfaces therebetween for substantially enclosing and compressively retaining the resonating means between the first and second compensating means, the top and bottom surfaces of the housing means being thermally coupled to the top surface of the first compensating means and the bottom surface of the second compensating means, respectively, whereby a low thermal resistance path is produced between the resonating means, first and second compensating means, and the housing means for conducting away from said resonating means heat dissipated therein thereby minimizing the temperature rise of said resonating means due to power dissipation.

2. The RF filter according to claim 1, wherein said tuning means includes a tuning shaft and a tuning slug, the tuning slug being comprised of the same material as the resonating means.

3. The RF filter according to claim 2, wherein said tuning shaft is threaded and said housing means further includes threaded bushing means adapted to receive the tuning shaft.

4. The RF filter according to claim 3, wherein said tuning shaft, bushing means and housing means are comprised of different materials having different coefficients of expansion with temperature for compensating for changes in the resonating means resonant frequency due to changes in temperature.

5. The RF filter according to claim 1, wherein said first and second compensating means are substantially comprised of alumina.

6. The RF filter according to claim 1, wherein said resonating means is substantially comprised of a material including barium oxide (BaO), titanium oxide ($TiO_2$) and zirconium oxide ($ZrO_2$).

7. A radio frequency (RF) filter coupled to an input signal from a signal source and producing an output signal, said RF filter comprising:

resonating means, having top and bottom surfaces with a hole disposed therebetween, being comprised of a ceramic material having a predetermined thermal conductivity;

first and second compensating means each having top and bottom surfaces, and being disposed above and below the resonating means, respectively, the bottom surface of the first compensating means and the top surface of the second compensating means being thermally coupled to the top and bottom surfaces of the resonating means, respectively, the first compensating means including a hole substantially concentrically aligned with the hole of the resonating means, and the first and second compensating means being comprised of a dielectric material having a thermal conductivity greater than the predetermined thermal conductivity of the resonating means ceramic material;

tuning means comprised of a dielectric material and being insertable into the holes of the first compensating means and resonating means for changing the resonant frequency of the resonanting means; and housing means including an input probe for coupling the inpout signal to said RF filter, an output probe disposed at a predetermined distance from the input probe for coupling the output signal from said RF filter, and top and bottom surfaces, and side surfaces therebetween for substantially enclosing and compressively retaining the resonating means between the first and second compensating means, the top and bottom surfaces of the housing means being thermally coupled to the top surface of the first compensating means and the bottom surface of the second compensating means, respectively, whereby a low thermal resistance path is produced between the resonating means, first and second compensating means, and the housing means for conducting away from said resonating means heat dissipated therein thereby minimizing the temperature rise of said resonating means due to power dissipation.

8. The RF filter according to claim 7, wherein said tuning means includes a tuning shaft and a tuning slug, the tuning slug being comprised of the same material as the resonating means.

9. The RF filter according to claim 8, wherein said tuning shaft is threaded and said housing means further includes threaded bushing means adapted to receive the tuning shaft.

10. The RF filter according to claim 9, wherein said tuning shaft, bushing means and housing means are comprised of different materials having different coefficients of expansion with temperature for compensating for changes in the resonating means resonant frequency due to changes in temperature.

11. The RF filter according to claim 7, wherein said first and second compensating means are substantially comprised of alumina.

12. The RF filter according to claim 7, wherein said resonating means is substantially comprised of a material including barium oxide (BaO), titanium oxide ($TiO_2$), and zirconium oxide ($ZrO_2$).

13. A radio frequency (RF) filter coupled to an input signal from a signal source and producing an output signal, said RF filter comprising:

resonating means, having top and bottom surfaces with a hole disposed therebetween, being comprised of a ceramic material having a dielectric constant of at least twenty (20), a predetermined thermal conductivity and a predetermined rate of change of resonant frequency with temperature;

first and second compensating means each having top and bottom surfaces and being disposed above and below the resonating means, respectively, the bottom surface of the first compensating means and the top surface of the second compensating means being thermally coupled to the top and bottom surfaces of the resonating means, respectively, the first compensating means including a hole substantially concentrically aligned with the hole of the resonating means, the first and second compensating means being comprised of alumina having a rate of change of resonant frequency with temperature opposite in polarity to the predetermined rate of change, and the dielectric material of the first and second compensating means further having a theraml conductivity greater than the predetermined thermal conductivity of the resonating means ceramic material;

tuning means comprised of a dielectirc material and being insertable into the holes of the first compensating means and resonating means for changing the resonant frequency of the resonanting means; and housing means including an input probe for coupling the input signla to said RF filter, an output probe disposed at a predetermined distance from the input probe for coupling the output signal from said RF filter, and top and bottom surfaces, and side surfaces therebetween for substantailly enclosing and compressively retaining the resonating means between the first and second compensating means, the top and bottom surfaces of the housing means being thermally coupled to the top surface of the first compensating means and the bottom surface of the second compensating means, respectively, whereby a low thermal resistance path is produced between the resonating means, first and second compensating means, and the housing means for conducting away from said resonating means heat dissipated therein thereby minimizing the temperature rise of said resonating means due to power dissipation.

* * * * *

UNITED STATES PATENT AND TRADEMARK OFFICE

CERTIFICATE OF CORRECTION

PATENT NO. : 4,661,790

DATED : April 28, 1987

INVENTOR(S) : Mark A. Gannon, et al.

It is certified that error appears in the above-identified patent and that said Letters Patent is hereby corrected as shown below:

Column 5, line 68, change the word "grater" to --greater--.

Column 6, line 9, the word "prove" should be --probe--.

Column 7, line 7, the word "inpout" should be --input--.

Column 8, line 22, the word "theraml" should be --thermal--.

Column 8, line 31, "signla" should be --signal--.

Signed and Sealed this

Eighth Day of September, 1987

*Attest:*

*Attesting Officer*

DONALD J. QUIGG

*Commissioner of Patents and Trademarks*